US009400103B1

(12) United States Patent
Cap et al.

(10) Patent No.: US 9,400,103 B1
(45) Date of Patent: Jul. 26, 2016

(54) REFILLABLE LIQUID CANDLE

(71) Applicant: Nature's Gifts International, LLC, Knoxville, TN (US)

(72) Inventors: Daniel S. Cap, Knoxville, TN (US); Scott Goebel, Knoxville, TN (US)

(73) Assignee: Nature's Gifts International, LLC, Knoxville, TN (US)

( * ) Notice: Subject to any disclaimer, the term of this patent is extended or adjusted under 35 U.S.C. 154(b) by 44 days.

(21) Appl. No.: 14/271,523

(22) Filed: May 7, 2014

Related U.S. Application Data

(60) Provisional application No. 61/913,539, filed on Dec. 9, 2013.

(51) Int. Cl.
*F23D 3/00* (2006.01)
*F23D 3/16* (2006.01)
*C11C 5/00* (2006.01)

(52) U.S. Cl.
CPC .. *F23D 3/16* (2013.01); *C11C 5/006* (2013.01)

(58) Field of Classification Search
CPC ..... F23D 3/16
USPC ..... 431/288, 292
See application file for complete search history.

(56) References Cited

U.S. PATENT DOCUMENTS 4,102,634 A * 7/1978 Crisp ..... F21S 13/00 431/298
4,878,832 A * 11/1989 Lynch ..... F21S 13/00 431/120
2006/0057528 A1* 3/2006 Kubicek ..... F23D 3/16 431/292

FOREIGN PATENT DOCUMENTS

CA 2427461 A1 * 10/2004 ..... F21S 13/12

* cited by examiner

*Primary Examiner* — Avinash Savani
(74) *Attorney, Agent, or Firm* — Luedeka Neely Group, PC

(57) ABSTRACT

A refillable liquid candle includes a container; a nonflammable combustible liquid fuel disposed within the container; and a wick located in the container and having a portion of the wick disposed in the liquid fuel and an exposed portion of the wick located above the fuel and exposed to air for providing a flame site, the wick configured to transport the fuel to the flame site. The candle consumes the liquid fuel when ignited to provide a flame at the flame site, and the liquid fuel may be replaced by adding additional liquid fuel to replace the consumed liquid fuel.

3 Claims, 15 Drawing Sheets

REFILLABLE LIQUID CANDLE

CROSS-REFERENCE TO RELATED APPLICATION

The application claims priority to U.S. Provisional Application No. 61/913,539 filed Dec. 9, 2013, entitled Refillable Liquid Candle, and incorporated herein by reference in its entirety.

FIELD

The present disclosure relates to liquid fuel candles. More particularly, the disclosure relates to refillable liquid fuel candle systems having improved construction and utilizing nonflammable combustible liquid as a fuel.

BACKGROUND

Improvement is desired in the construction of indoor flame lights and decorations. Conventional indoor flame lights and decoration devices include solid candles and oil lamps that burn either vegetable or petroleum based oils. In particular, improvement is desired in the construction of liquid fuel based flame lights or candles.

The present disclosure advances the art by providing a refillable liquid fuel candle that overcomes many of the shortcomings associated with solid candles and oil lamps.

SUMMARY

The disclosure advantageously provides a refillable liquid candle.

In one embodiment, the candle includes a container, a nonflammable combustible liquid fuel disposed within the container, and a wick located in the container. A portion of the wick is disposed in the liquid fuel and an exposed portion of the wick is located above the fuel and exposed to air for providing a flame site. The wick is configured to transport the fuel to the flame site.

The candle consumes the liquid fuel when ignited to provide a flame at the flame site, and the liquid fuel may be replaced by adding additional liquid fuel to replace the consumed liquid fuel.

In one aspect, the wick assembly may be a floating wick assembly.

BRIEF DESCRIPTION OF THE DRAWINGS

Further advantages of the disclosure are apparent by reference to the detailed description when considered in conjunction with the figures, which are not to scale so as to more clearly show the details, and wherein.

DETAILED DESCRIPTION

Figure 1:
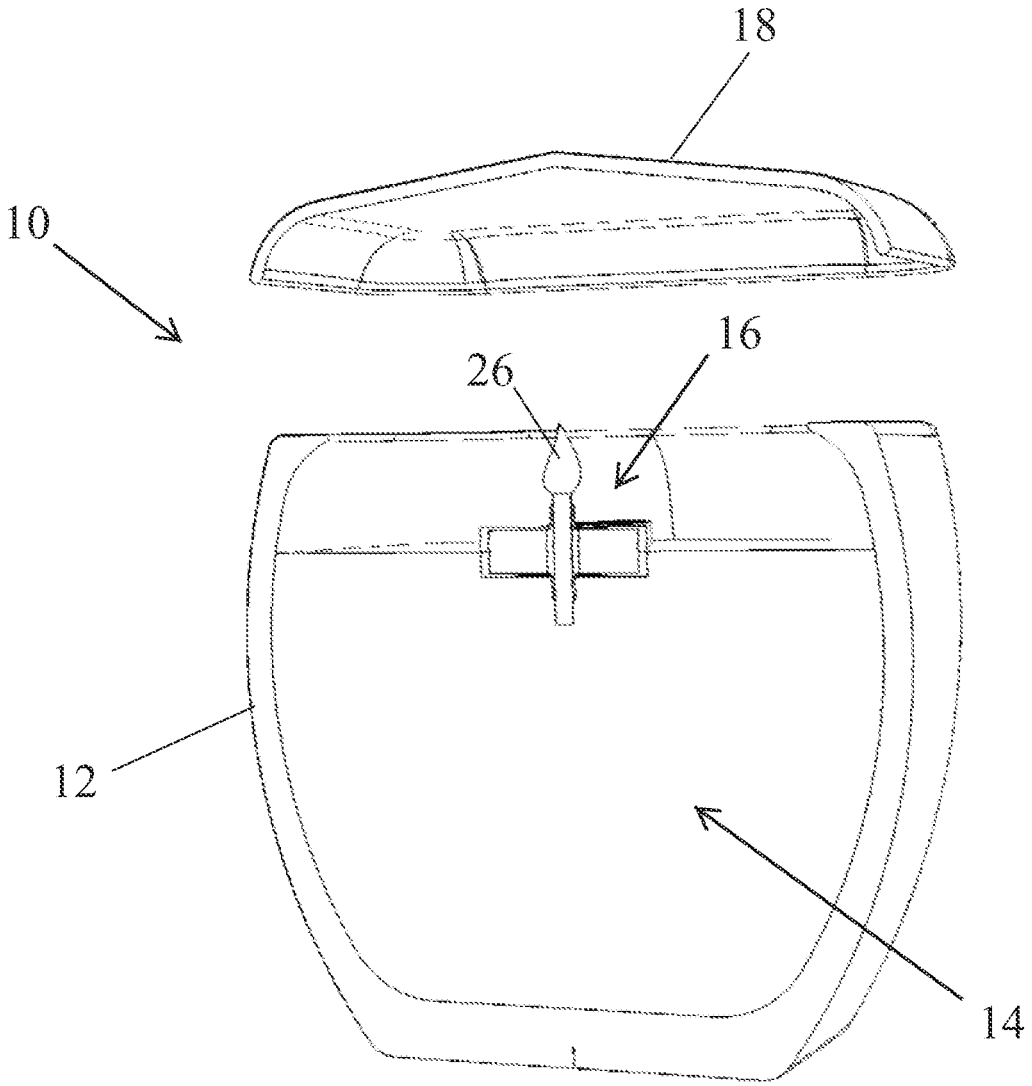
FIGS. 1 and 2 are perspective cross-sectional views depicting a refillable liquid candle according to the disclosure.
Figure 2:
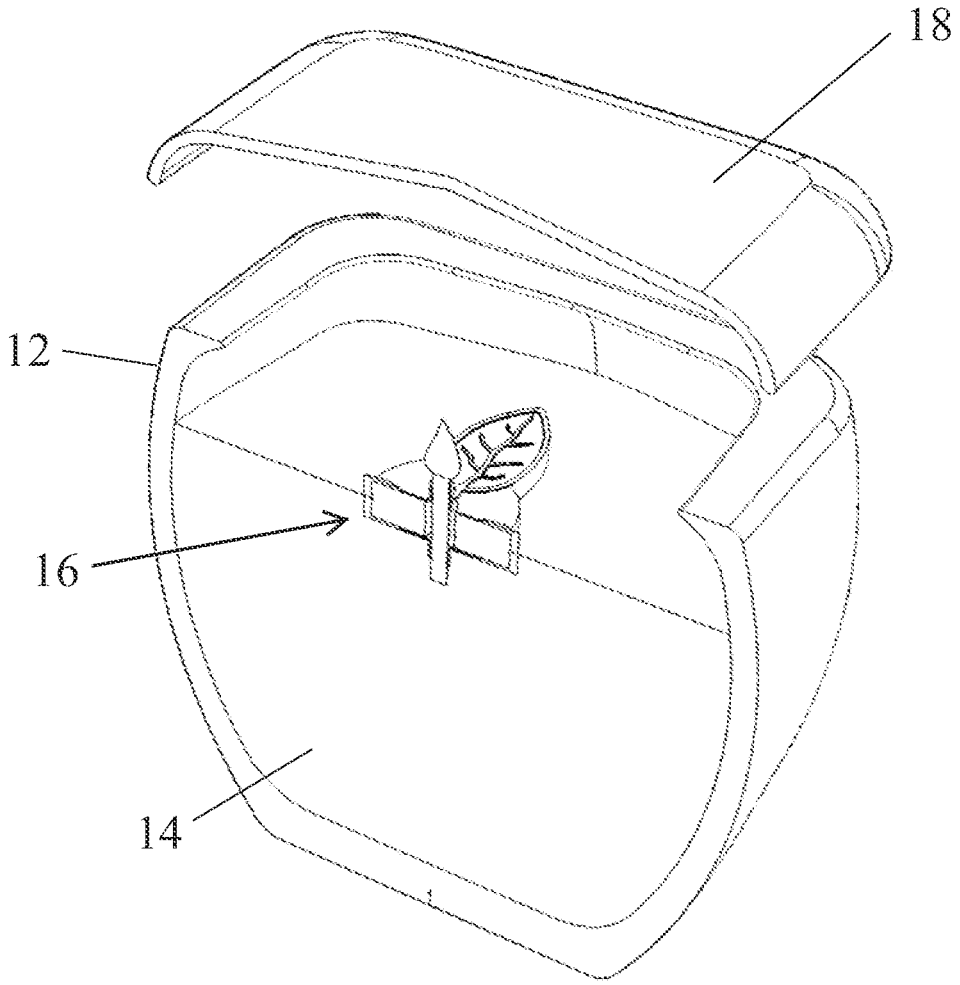

With initial reference to FIGS. 1-5, there is shown a refillable liquid candle 10 including an open top container 12, a liquid fuel or fuels designated generally by reference numeral 14, a floating wick assembly 16, and a removable lid 18.

The open top container 12 is configured to contain the fuel 14 and may be made of various materials such as glass, wood, clay, plastic, metal, borosilicate, PET, PE, HDPE, stainless steel, aluminum, etc., and is preferably a candle rated glass open top container. The open top container 12 may be of any design including the incorporation of a splash guard to inhibit the fuel 14 from splashing or spilling out. The design may be optimized for three-dimensional light throw. The open top container 12 may also incorporate attached or imbedded magnets. In a preferred embodiment, the open top container 12 is made of a candle rated clear glass that is designed to maximize the three-dimensional throw of the candle flame light while incorporating a liquid fuel splash reducing shape and may also be covered with the lid 18.

The liquid fuel or fuels 14 may be provided as by nonflammable combustible liquids including, but not limited to, vegetable oils, liquid paraffin, kerosene, methyl esters, glycols, lamp oil, etc. or any combination thereof. The liquid fuel 14 may also be provided by non-miscible phases meeting the previously mentioned criteria. It is preferred that the fuel be nontoxic, nonhazardous and biodegradable made from natural, renewable, sustainable resources such as vegetable oil methyl esters and vegetable based propylene glycols. Methyl esters are oil soluble non-polar hydrophobic substances while propylene glycol is a water soluble polar hydrophilic substance.

Both the methyl ester and vegetable based propylene glycol fuel phases contain an antioxidant preservative such as but not limited to Butylated hydroxytoluene (BHT), Tertiary Butylhydroquinone (TBHQ), Butylated hydroxyanisole (BHA), Propyl gallate, Octyl gallate, Dodecyl gallate, Erythorbic acid, Sodium erythorbate, 4-Hexylresorcinol, Tocopherol compounds, Ascorbic Acid compounds and combinations thereof added in the amounts ranging from 1 to 10,000 ppm, more specifically 100 to 2000 ppm, ideally 200 to 1000 ppm to increase stability and prevent oxidation, rancidity and polymerization.

Both the methyl ester and vegetable based propylene glycol fuel phases contain a surface tension reducer such as surface tension reducers from the group 2-octanol, sulfonated oils, organic phosphites, glyceryl soyate, silicone compounds, and combinations thereof added in the amounts ranging from 1 to 500 ppm, more specifically 3 to 50 ppm, ideally 5 to 15 ppm to facilitate the movement of the floating wick assembly placed on the surface of the fuels. Also, the fuel 14 may include antifoaming agents to improve the scent throw of fragrances in the fuel, such antifoam agents being described in U.S. Pat. No. 7,588,607 issued Sep. 15, 2009, entitled "Candlewax Compositions With Improved Scent-Throw," incorporated herein by reference in its entirety.

Figure 3:
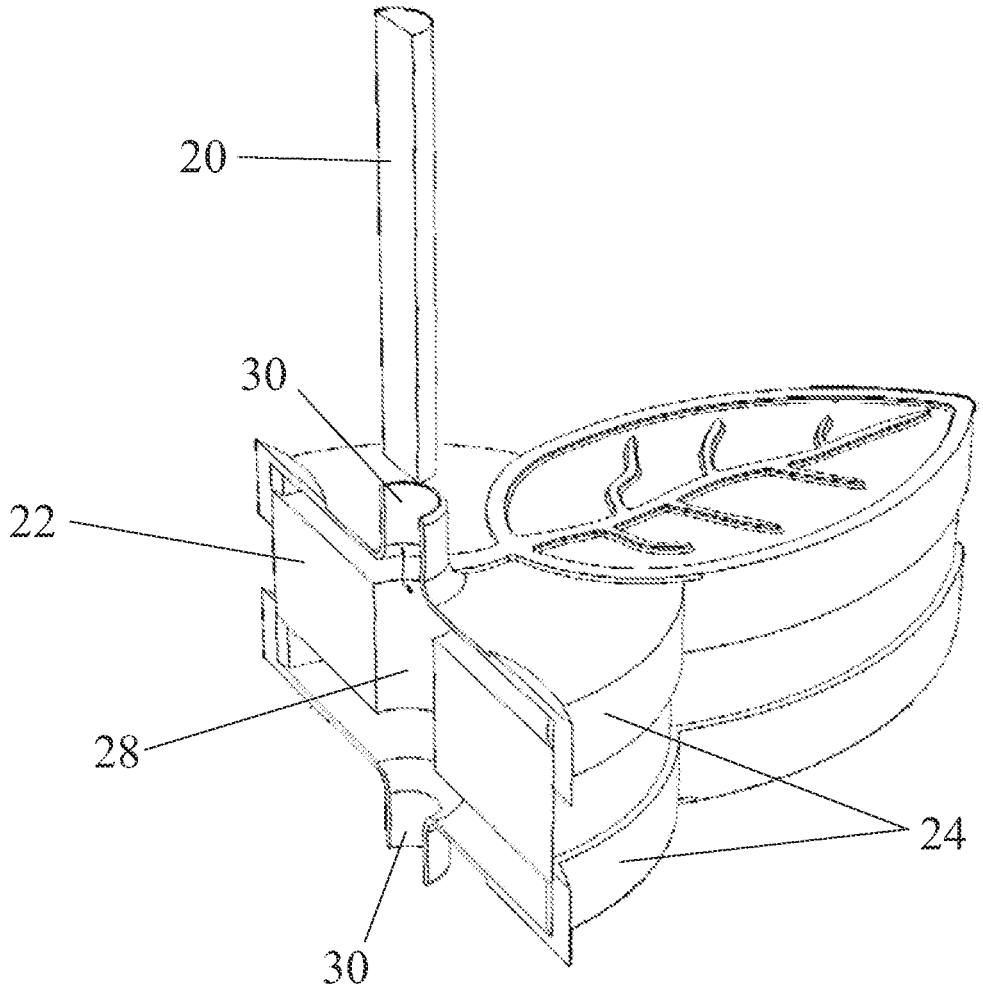
FIGS. 3, 4, and 5 show a floating wick assembly of the candle of FIGS. 1 and 2.
Figure 4:
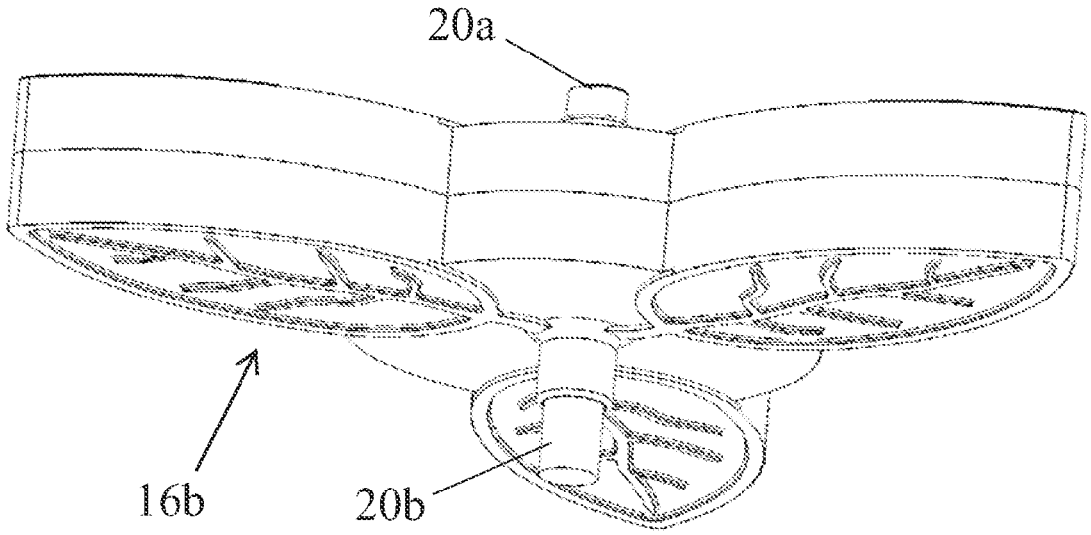
Figure 5:
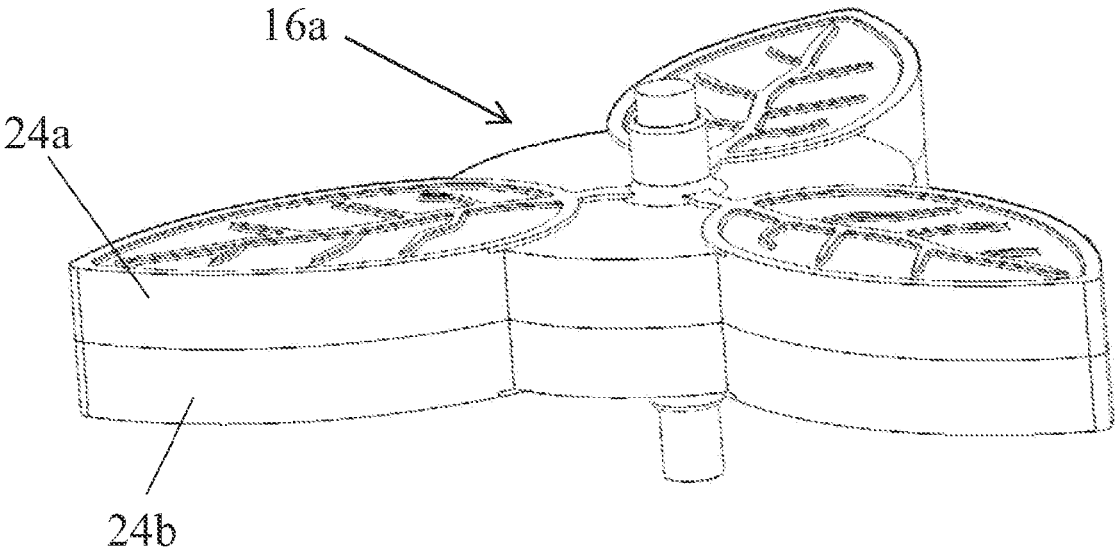
Figure 6:
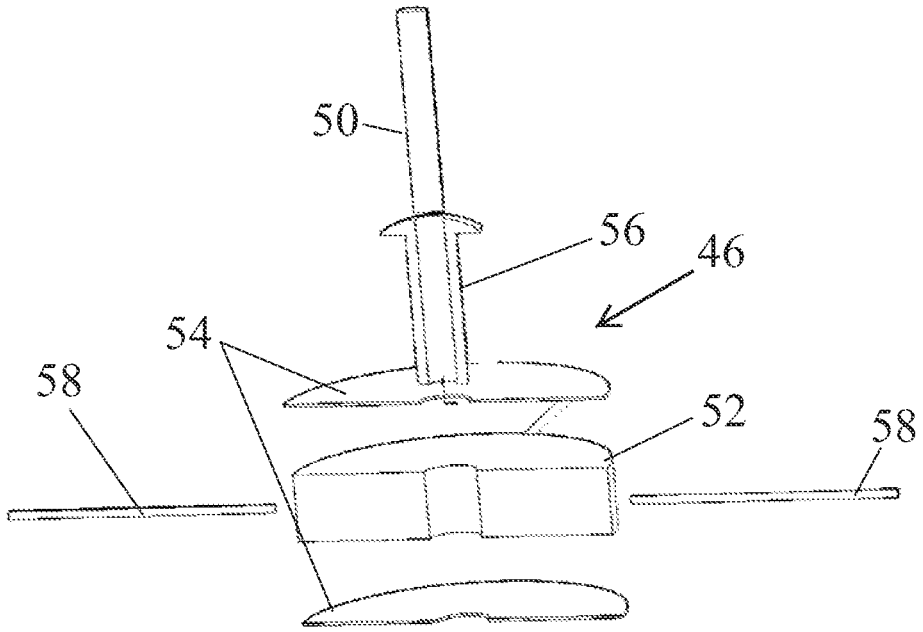
FIGS. 6, 7, and 8 show a self-centering floating wick assembly according to an alternate embodiment of the disclosure.
Figure 7:
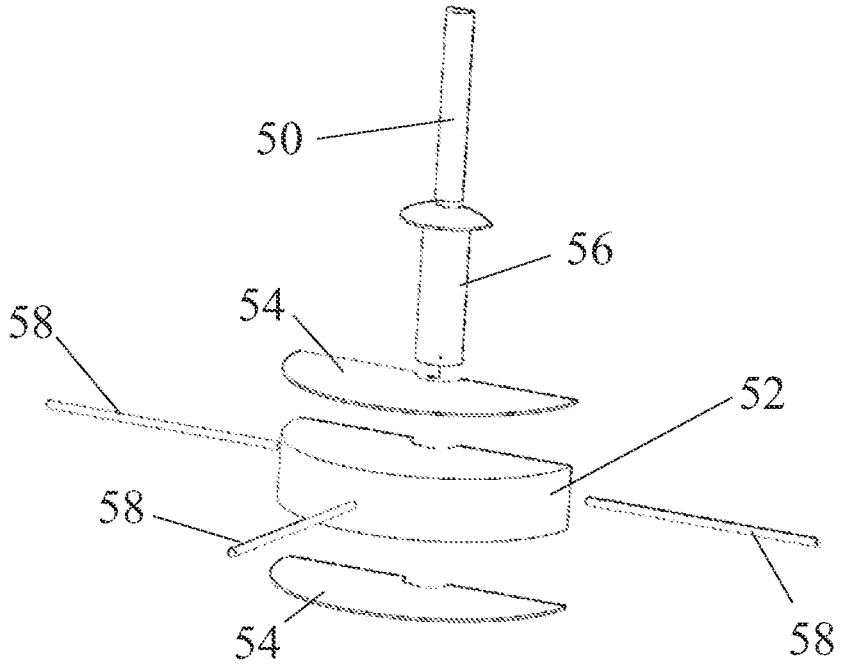
Figure 8:
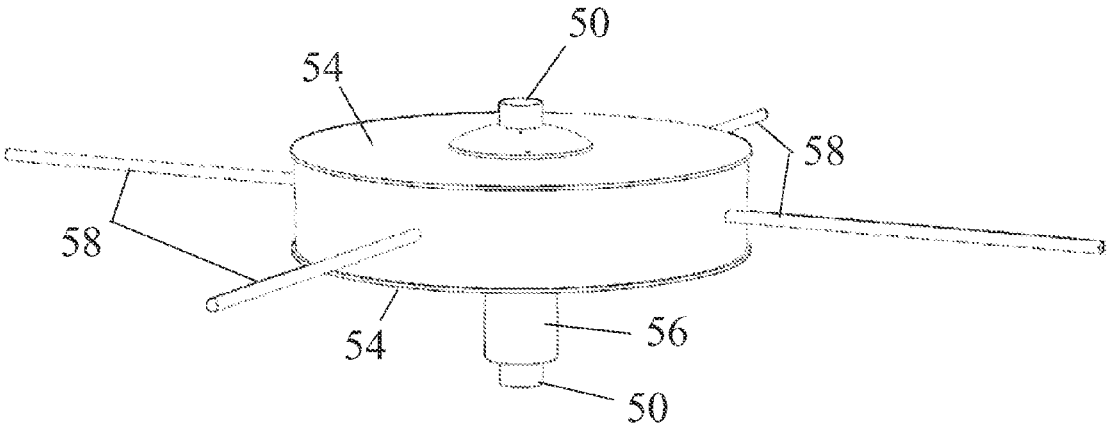
Figure 9:
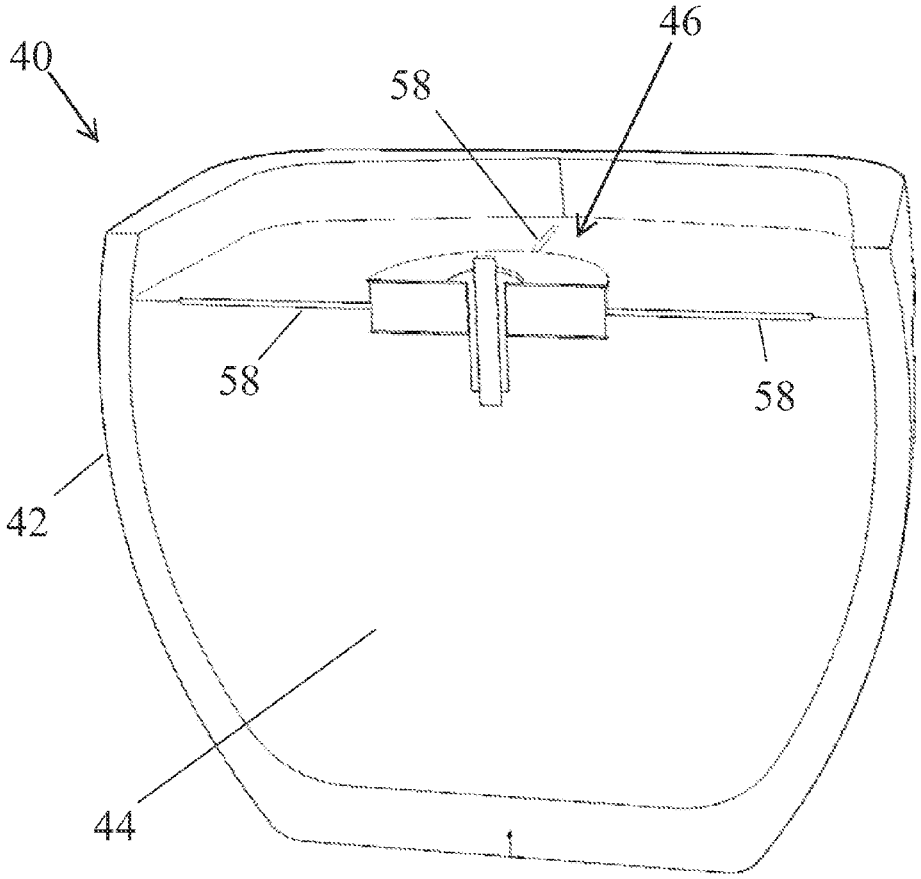
FIG. 9 shows a refillable liquid candle having the self-centering floating wick assembly of FIGS. 6-8.

With additional reference to FIGS. 3-5, the floating wick assembly 16 may include a wick 20, a buoyant float 22, and a heat shield 24 to protect the float 22. The floating wick assembly 16 is configured to maintain an end 20*a* of the wick 20 in the liquid fuel 14 while maintaining an opposite end 20*b* of the wick 22 exposed to air above the fuel 14 for providing a flame site for location of a flame 26 when the candle 10 is ignited and the flame 26 is disposed at the flame site.

A top 16*a* and a bottom 16*b* of the floating wick assembly 16 are preferably symmetrical so that if the assembly is flipped over consistent function and aesthetics are insured regardless of which side is up, allowing for accidental submerging and flipping. Thus, an end of the wick 20 is maintained in the liquid fuel 18 while maintaining an opposite end of the wick 20 exposed to air above the fuel 18, regardless of whether the top 16*a* or the bottom 16*b* of the floating wick assembly 16 is disposed in the fuel.

The wick 20 may be a non-consuming wick made from but not limited to fiberglass, ceramic, wire mesh, etc. to eliminate constant replacing of the wick. The wick 20 is desirably capable of supporting the capillary action of both polar and non-polar liquids simultaneously.

The float 22 is made of a buoyant material such as balsa wood, cork, foam, charcoal, pumice; it may even be an air space. The float 22 includes a central aperture 28 for passage of the wick 20.

The heat shield 24 is configured to encase the float 22 and to provide a decorative and ornamental appearance to the floating wick assembly 16. The heat shield 24 is made of a lightweight heat resistant material such as aluminum or other thin sheet metal, flame resistant plastics, ceramic, or a flame resistant coating, or the like lightweight, flame resistant material. The heat shield 24 may be provided as an upper portion 24*a* and a lower portion 24*b* that snap fit or otherwise join together to encase the float 22. The heat shield 24 is configured to provide an aperture 30 aligned with the aperture 28 for passage of the wick 20 and configured to provide a supportive column to maintain the ends 20*a* and 20*b* of the wick 20 so that they extend substantially perpendicular in a direction away from the heat shield 24.

The removable lid 18 may be made of various materials such as glass, wood, clay, plastic, metal, borosilicate, PET, PE, HDPE, stainless steel, aluminum, etc. The consumer has the option of discontinuing fragrance delivery by placing the removable lid 18 on the top of the container 12. The lid 18 may be leak proof via a seal disposed on the lid 18 to seal relative to the container 12. The lid 18 may be of a flat configuration with a reflective surface on the inside such that it may be used as a coaster for the container 12 to enhance the light throw upward. The container 12 and the lid 18 may cooperate to lock the lid 18 onto the container 12. For example, cooperating threads, a mechanical lever, and like locking devices may be integrated into the container 12 and the lid 18 if desired.

With reference to FIGS. 6-9, there is shown another embodiment of a refillable candle 40 having an open top container 42, a liquid fuel or fuels designated generally by reference numeral 44, and a floating wick assembly 46. The container 42 and the fuel 44 are preferably substantially similar to the container 12 and the fuel 14.

The floating wick assembly 46 is substantially similar to the floating wick assembly 16, and includes a wick 50, a buoyant float 52, and a heat shield 54 to protect the float 52. The wick 50, float 52, and the heat shield 54 may be substantially similar to the wick 20, the float 22, and the heat shield 24. In this regard, the heat shield 54 includes a separate wick support 56 that functions to support the wick 50 in the manner of the aperture 30 of the heat shield 24.

The floating wick assembly 46 is further configured to include structure for maintaining the wick assembly 46 in a substantially centered position within the container 42. For example, a plurality of outriggers, such as rods 58, are uniformly spaced about the float 52 and extend laterally from the float 52. The rods 58 are sized to extend closely adjacent the interior walls of the container 42 so as to substantially center the floating wick assembly 46 within the container 42, and maintain the wick 52 away from the sidewalls of the container 42.

Figure 10:
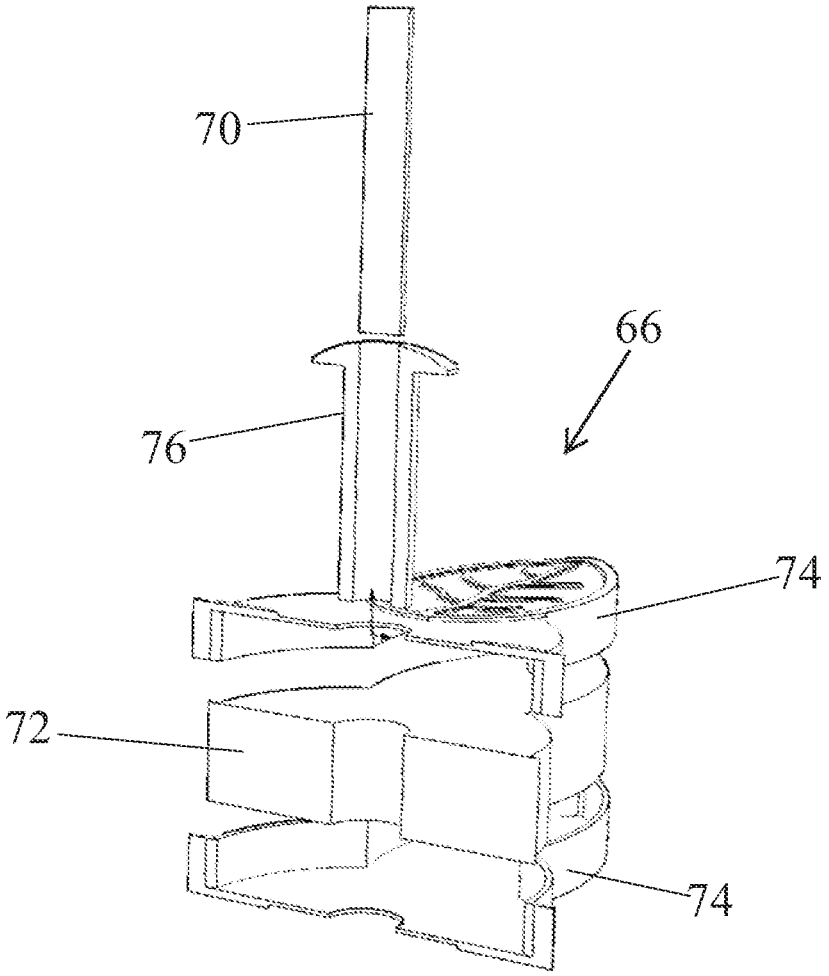
FIG. 10 shows use of a magnet with an alternate embodiment of a floating wick assembly according to the disclosure.
Figure 11:
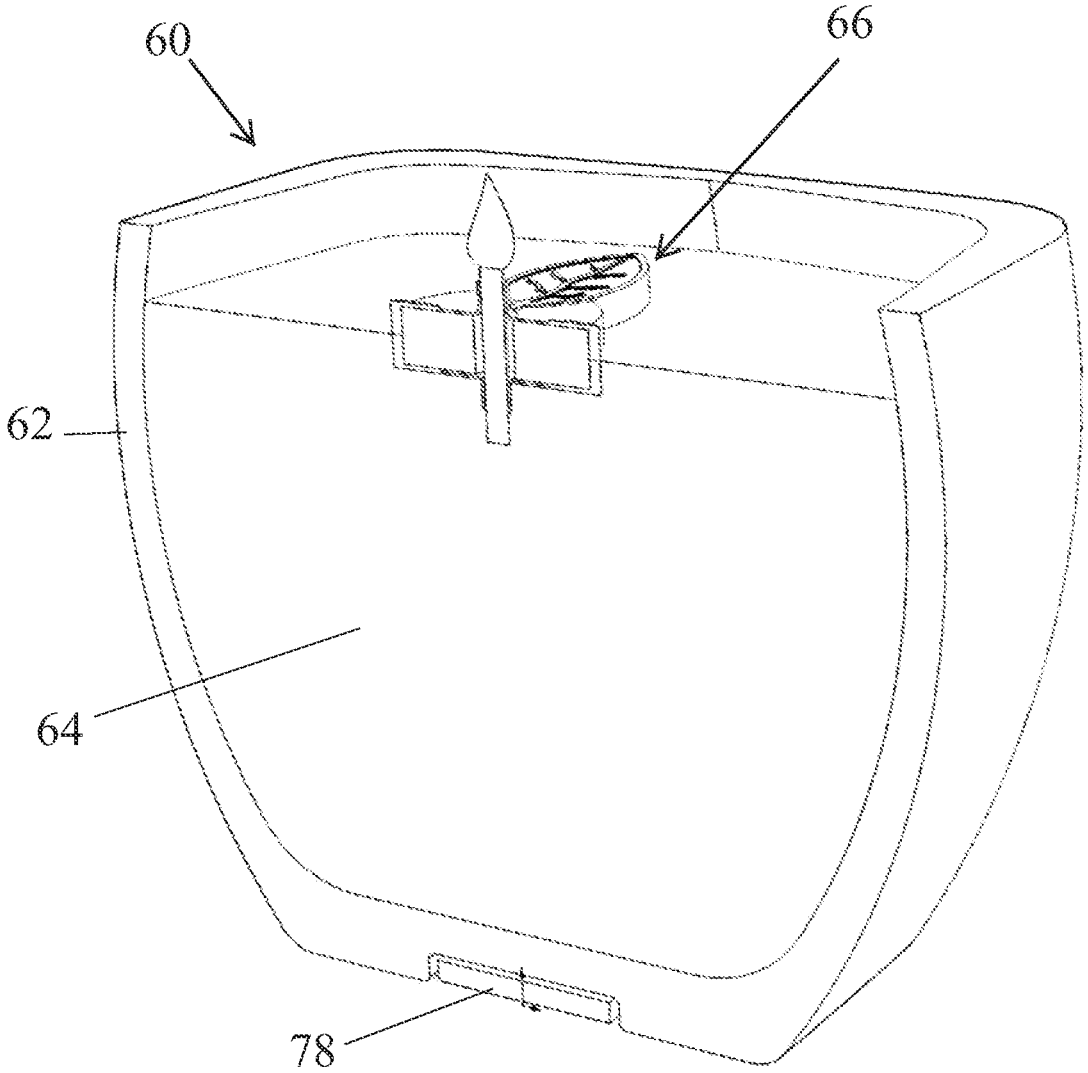
FIG. 11 shows a refillable liquid candle having the floating wick assembly of FIG. 10 and including another magnet in a container for the candle.

With reference to FIGS. 10 and 11, there is shown another embodiment of a refillable candle 60 having an open top container 62, a liquid fuel or fuels designated generally by reference numeral 64, and a floating wick assembly 66. The container 62 and the fuel 64 are preferably substantially similar to the container 12 and the fuel 14.

The floating wick assembly 66 is substantially similar to the floating wick assembly 16, and includes a wick 70, a buoyant float 72, and a heat shield 74 to protect the float 72. The wick 70, float 72, and the heat shield 74 may be substantially similar to the wick 20, the float 22, and the heat shield 24. In this regard, the heat shield 74 includes a separate wick support 76 that functions to support the wick 70 in the manner of the aperture 30 of the heat shield 24.

The floating wick assembly 66 is further configured to utilize magnetic interaction to maintain the wick assembly 66 in a substantially centered position within the container 62. For example, a magnet 78 is centrally located at the bottom of the container 62. Also, the wick support 76 or other central portions of the heat shield 74 are made of a magnetic metal. The magnetic metal of the wick support 76 is attracted to the magnetic field of the magnet 78, holding it centered to the container 62. A balance of magnetic field strength, amount of magnetic metal and buoyant material used for the float 72 is achieved so that when the container 62 is full the floating wick assembly 66 is attracted sufficiently to center itself. The balance is also such that when the liquid fuel 64 decreases in depth the floating wick assembly 66 is not pulled under the liquid fuel by too strong of a magnetic attraction.

Figure 12:
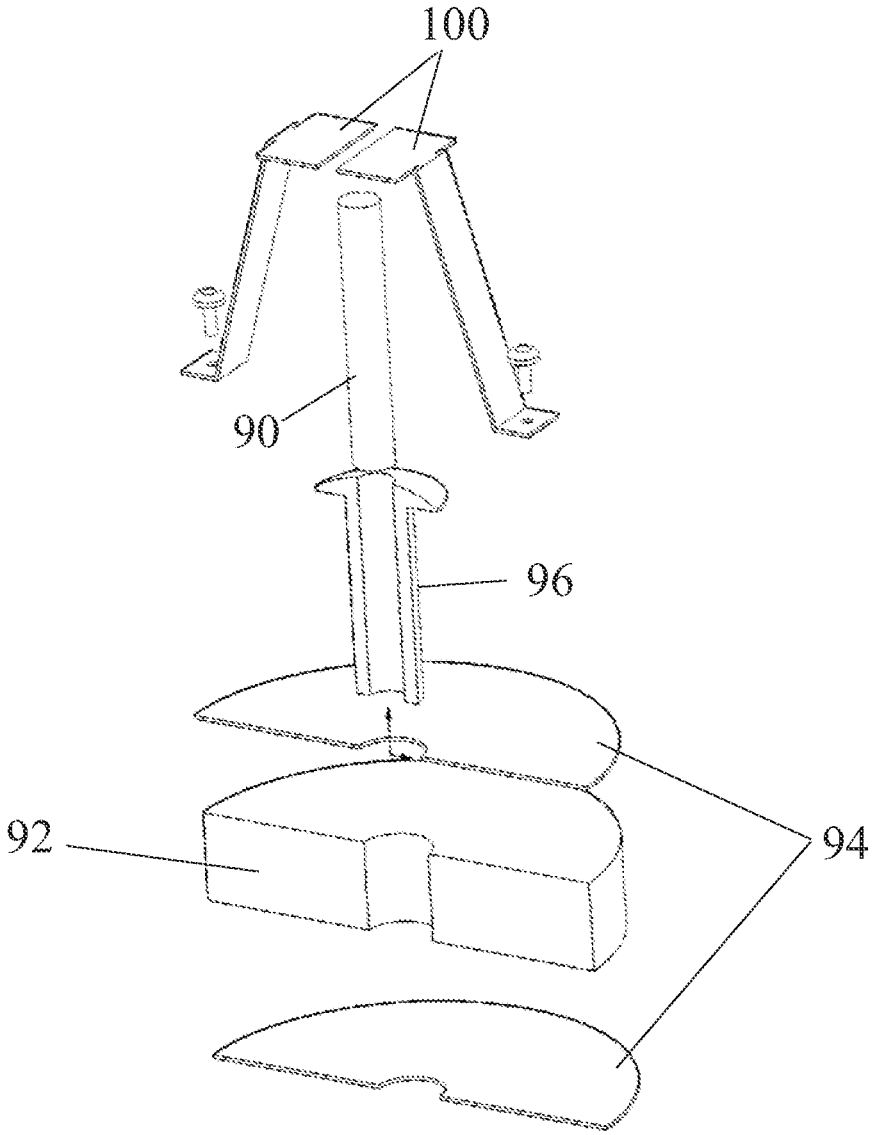
FIG. 12 shows a floating wick assembly according another embodiment and configured to interact with convection currents from a flame causing the floating wick assembly to spin.
Figure 13:
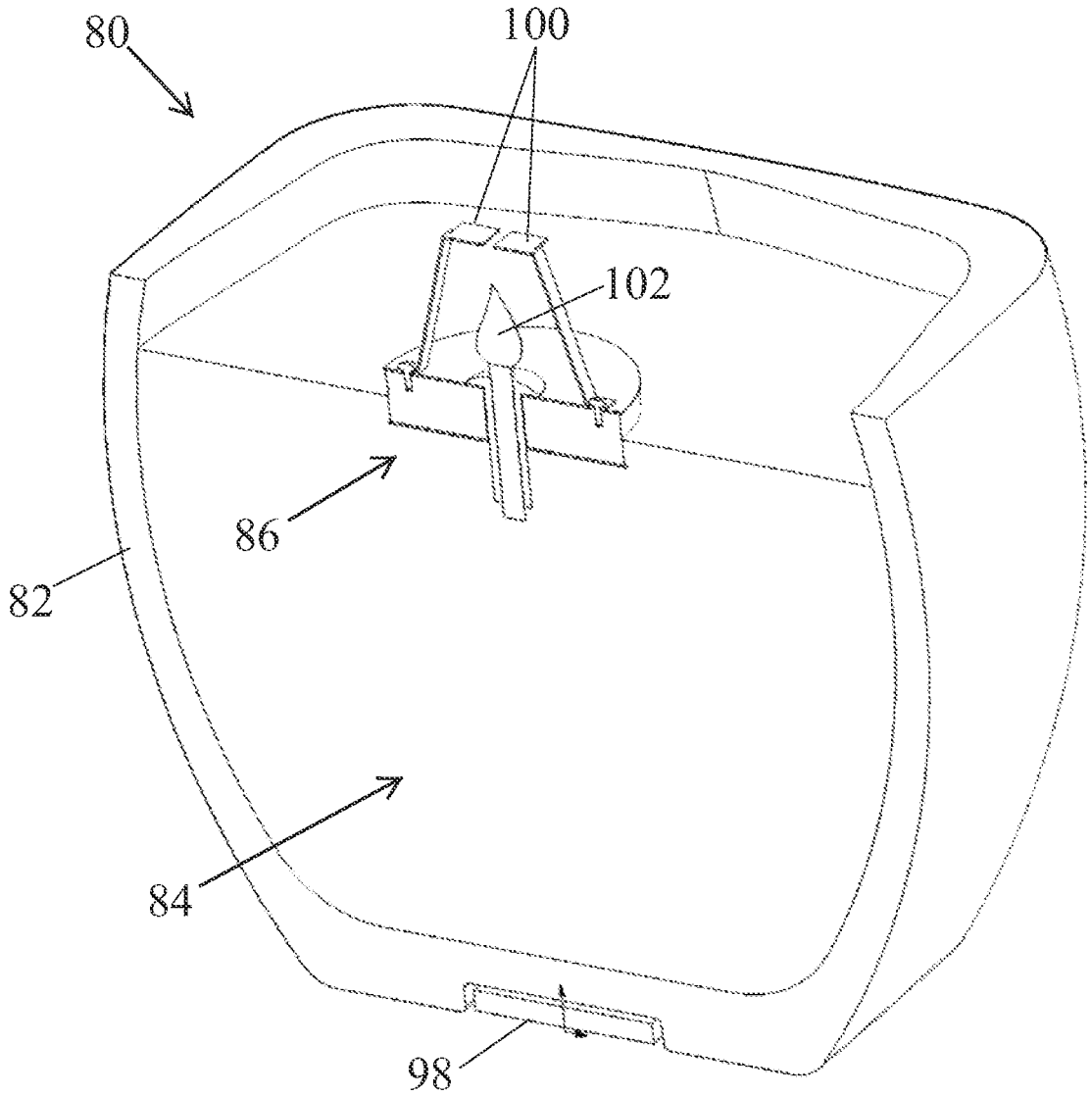
FIG. 13 shows a refillable liquid candle having the floating wick assembly of FIG. 12.

With reference to FIGS. 12 and 13, there is shown another embodiment of a refillable candle 80 having an open top container 82, a liquid fuel or fuels designated generally by reference numeral 84, and a floating wick assembly 86. The container 82 and the fuel 84 are preferably substantially similar to the container 12 and the fuel 14.

The floating wick assembly 86 is substantially similar to the floating wick assembly 16, and includes a wick 90, a buoyant float 92, and a heat shield 94 to protect the float 92. The wick 90, float 92, and the heat shield 94 may be substantially similar to the wick 20, the float 22, and the heat shield 24. In this regard, the heat shield 94 includes a separate wick support 96 that functions to support the wick 90 in the manner of the aperture 30 of the heat shield 24.

The floating wick assembly 86 is further configured to utilize magnetic interaction to maintain the wick assembly 66 in a substantially centered position within the container 62. For example, a magnet 98 is centrally located at the bottom of the container 82. Also, the wick support 96 or other central portions of the heat shield 94 are made of a magnetic metal. The magnetic metal of the wick support 96 is attracted to the magnetic field of the magnet 98, holding it centered to the container 82. A balance of magnetic field strength, amount of magnetic metal and buoyant material used for the float 92 is achieved so that when the container 92 is full the floating wick assembly 86 is attracted sufficiently to center itself. The balance is also such that when the liquid fuel 84 decreases in depth the floating wick assembly 86 is not pulled under the liquid fuel by too strong of a magnetic attraction.

In addition, the floating wick assembly 86 includes fins 100 located to extend above a flame 102 of the wick 90 and to capture convection currents from the flame 102. It has been observed that the interaction of the fins 100 with the flame 102 causes the floating wick assembly 86 to spin on the magnetic axis provided by the magnet 98 and the magnetic metal of the wick support 96 to provide desirable aesthetics.

Figure 14:
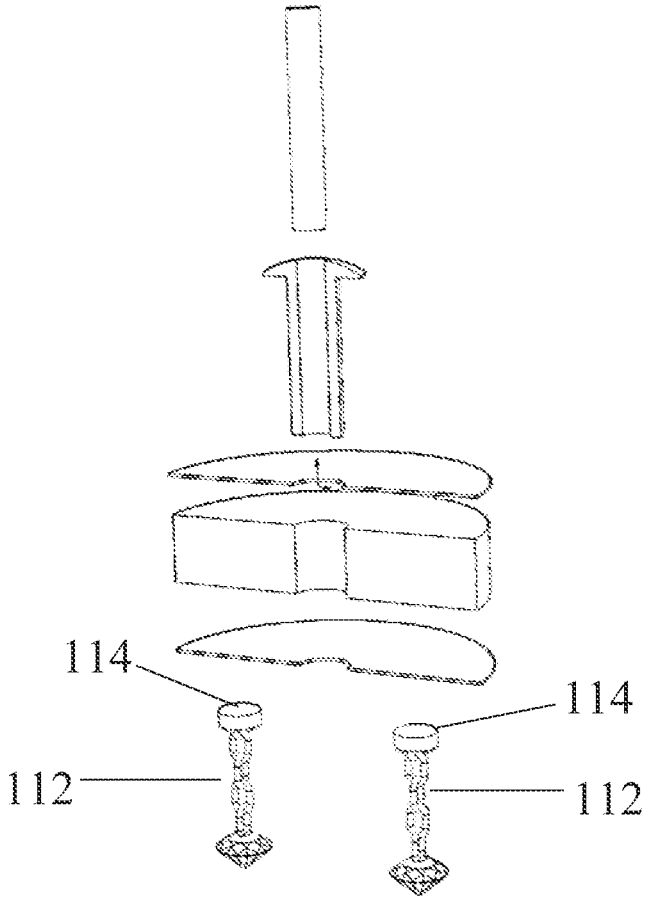
FIG. 14 shows a floating wick assembly according a further embodiment and incorporating dangling decorations.
Figure 15:
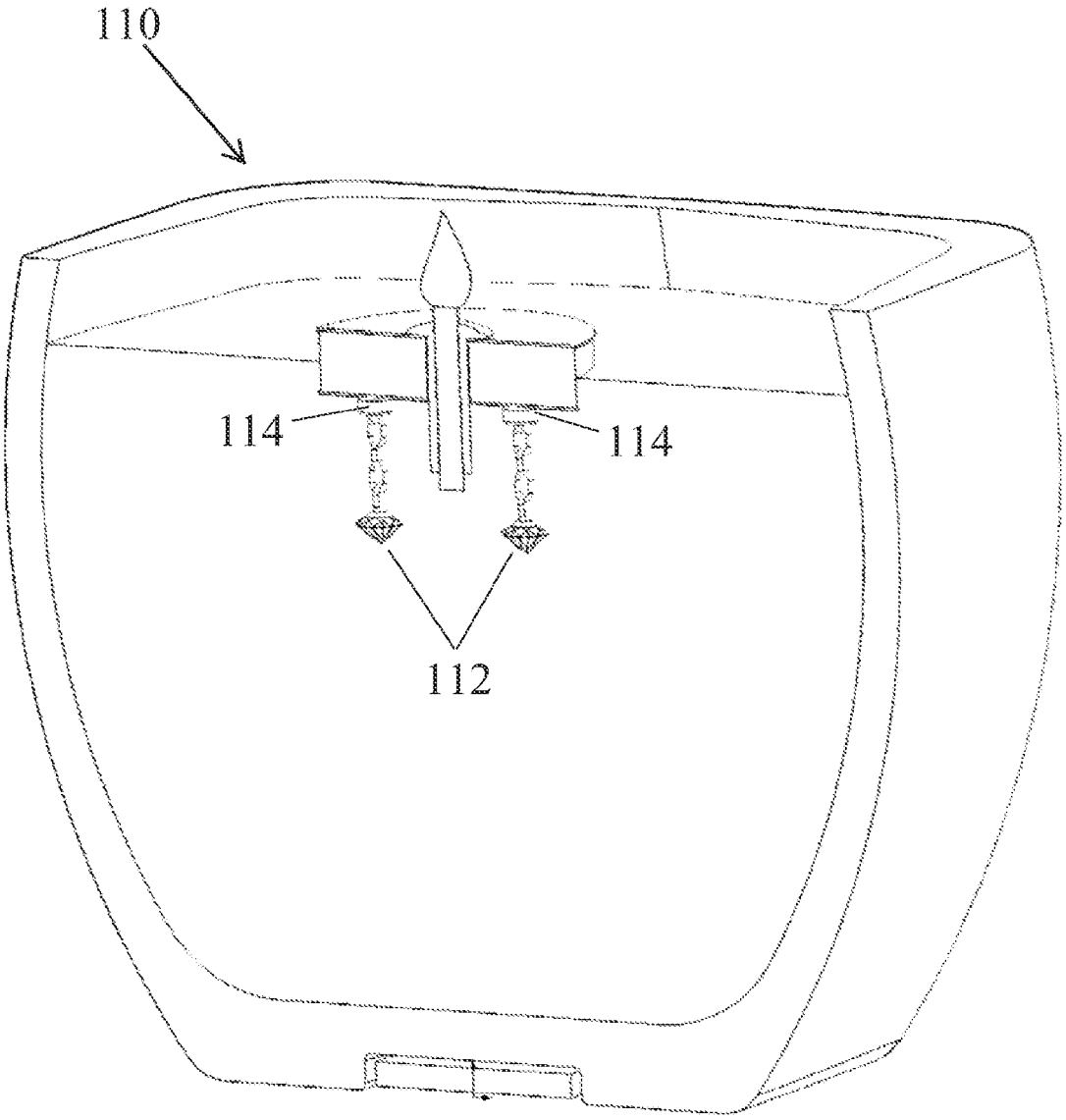
FIG. 15 shows a refillable liquid candle having the floating wick assembly of FIG. 14.

With reference to FIGS. 14 and 15, there is shown another embodiment of a refillable candle 110. The candle 110 is substantially similar to the candle 80 described in connection with FIGS. 12 and 13, and may include the fins 100, but is shown without the fins 100. The candle 110 includes decorations 112 that dangle from the underside of the floating wick assembly. The decorations 112 may be rigidly or releasably fixed to the floating wick assembly, and may be attached as by magnets 114. It is preferred to utilize the fins 100 to impart a spinning motion to accentuate the decorations 112. The container of the candle 110 preferably includes a magnet in the manner of the magnet 98 described for the candle 80 to provide a centering effect.

Figure 16:
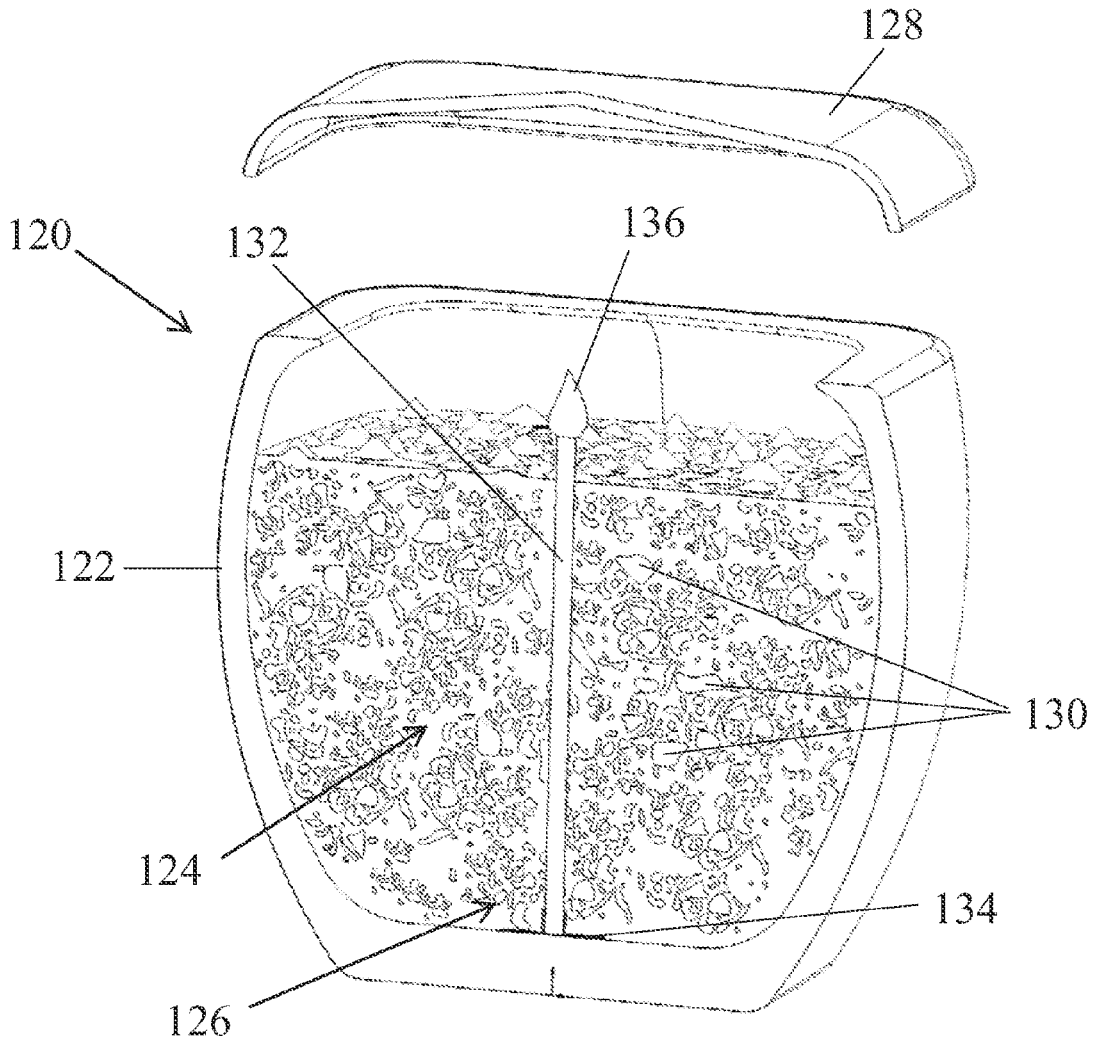
FIGS. 16 and 17 show an alternate embodiment of a refillable liquid candle according to the disclosure that does not include a floating wick assembly.
Figure 17:
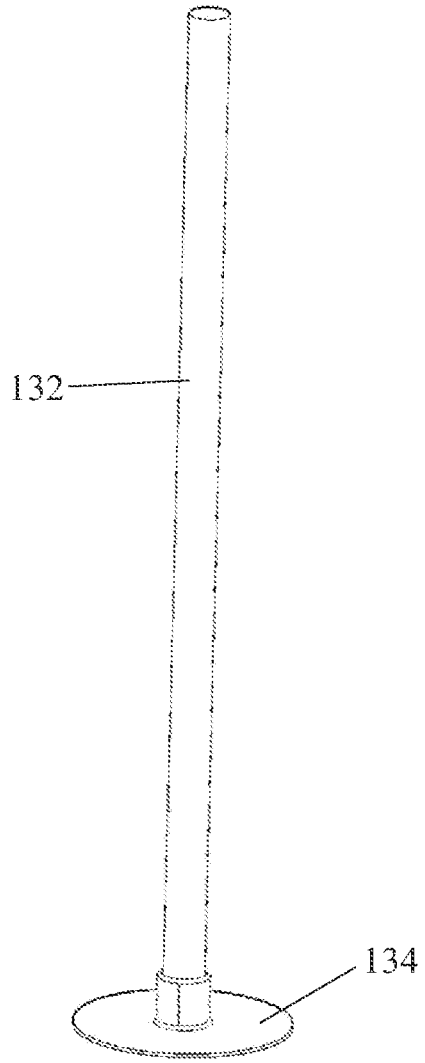

With reference to FIGS. 16 and 17, there is shown an alternate embodiment of a refillable liquid candle 120. The candle 120 does not include a floating wick assembly. As shown, the liquid candle 120 includes an open top container 122, liquid fuel 124, a tabbed wick assembly 126, a removable lid 128, and particulate medium 130. The container 122, the fuel 124, and the lid 128 are preferably substantially similar to the container 12, the fuel 14, and the lid 18.

The tabbed wick assembly 126 includes an elongate wick 132 crimped at a lowermost end to a clip 134. The wick 132 may be a non-consuming wick in the manner of the wick 20. The clip 134 may be made of a metal or other material suitable for immersion in the fuel 124, and serves to hold the wick 132 in place at the bottom of the container 122 by the particulate medium 130 bearing against the clip 134. In addition, if desired, the clip 134 may be secured to the bottom of the container 122 as by adhesive or the like. The particulate medium 130 may be provided as by gravel, glass, marbles, or the like having a density so as to not float. The particulate medium 130 serves to hold the wick 132 erect and in place. Also, the particulate medium 130 also serves to inhibit a flame 136 at the top of the wick 130 from encompassing too much of the wick 130 and becoming too large. The particulate medium 130 also serves an aesthetic function.

Figure 18:
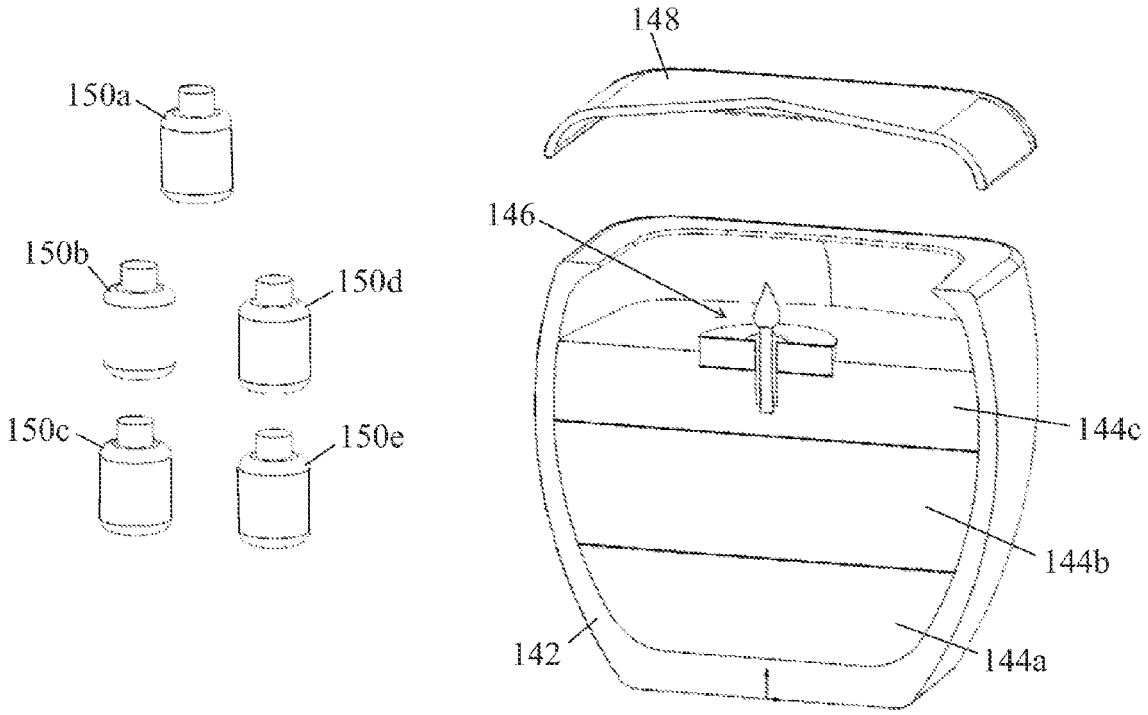
FIG. 18 depicts phase layers of fuels utilized in accordance with refillable candles according to the disclosure.

With reference to FIG. 18, there is shown another embodiment of a refillable candle 140 having an open top container 142, a plurality of distinct liquid fuel phases or layers designated generally by reference numerals 144*a*, 144*b*, and 144*c*, and a floating wick assembly 146. The container 142 and the floating wick assembly 146 may be similar to any of the previously described containers and floating wick assemblies. A removable lid 148 similar to the lid 18 may also be provided. Thus, as each fuel layer is consumed, the underlying one is exposed and provides its different aesthetics and characteristics to change the effect and experience.

The fuel layers 144*a*-144*c* may be provided as by mixing various liquid fuels, such as may be provided in vials 150*a*-150*e*. Each vial 150*a*-150*e* may contain a different fuel. When the fuels of two of the different vials 150*a*-150*e* are mixed together in the container 142 two different phases or layers are formed. As shown in FIG. 17, three of the vials 150*a*-150*e* have been mixed in the container 142 to form the layers 144*a*-144*c*. Each fuel in the vials 150*a*-150*e* may be substantially similar to the fuel 18, but contain additional and different chemically specific dye and fragrance targeted toward the respective polarities. Each fuel may also contain an antioxidant and surface tension reducing agent. Each of the fuels may be used one hundred percent in the candle 140, but also may be mixed at various percentages to create multiple phases.

It has been observed that the described fuels advantageously form phases (layers) in the candle without each phase contaminating the other phase. In addition, each phase (layer) of fuel may distinctly hold a different color without each phase contaminating the other phase. Also, each phase (layer) of fuel may advantageously hold separate distinct fragrance (s) in amounts ranging from about 0.01 to 100%, more specifically about 1 to 50%, ideally about 2 to 20% without each phase contaminating the other phase.

In this regard, it will be appreciated that the consumer may mix fragranced fuel of the same polarity to create a custom blended recipe unique to the consumer's desire. These custom recipe fuels of different polarities may then be layered on top of each other remaining separate, thereby giving an entirely new experience to the consumer by having distinct multiple layers of custom fragrance recipes. The fuel phases (layers) may also contain flame color changing additives such as salts (chlorides, carbonates, sulfates, nitrates, citrates and tartrates) of various metals including but not limited to strontium, calcium, sodium, potassium, barium, copper, lithium, aluminum, magnesium and titanium allowing each phase of fuel to produce a different colored flame.

Liquid fuel candles according to the disclosure have numerous benefits as compared to solid fuel candles. For example, the candles can be refilled as desired, and provide desired candle experiences. The fuel is wholly consumed leaving no messy residue such as in the case of solid candles. Decorations and other aesthetic affects may be easily incorporated and changed. Also, liquid fuel candles according to the disclosure have been observed to burn cooler with a burn pool temperature of about 100° F. as compared to a burn pool temperature for a paraffin candle of about 165° F. In addition, the liquid fuels are not flammable and will extinguish the flame if accidentally tipped over or splashed. Further, the wicks of the floating wick assemblies are relatively short and limited in length keeping a consistent flame height unlike when a solid container candle accidentally cracks during burning, spilling the liquefied wax and thereby exposing a greater portion of wick which may flare up with a larger potentially dangerous sized flame.

Liquid fuel candles according to the disclosure also have numerous benefits as compared to petroleum product oil lamps and open vegetable oil lamps. For example, the fuel is easy to clean up if spilled with either plain water or water with a touch of soap, the fuel is easily fragranced. Also, such as described in connection with FIG. 17, consumers may create multiple different phases of fuel, each with different colors and fragrances, and create customized colors and fragrances. Also, it has been observed that light from the flame clearly disperses three-dimensionally through and around the candle, fuel and container. The fuels also generally burn cleaner with reduced sooting, and are less viscous than vegetable oil giving it the appearance of water and having an enhanced capillary action quality facilitating wicking. It has also been observed that the fuels are more stable than vegetable oil and may be further stabilized reducing oxidation, rancidity and polymerization known to occur in vegetable oils. Oxidation and rancidity is undesirable and can cause foul odors and discoloration to occur in vegetable oils while polymerization causes gums and wax like substances to form clogging the wick of a lamp or candle.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A refillable liquid candle, the candle comprising:

a container;

a container magnet located proximate a bottom of the container;

a nonflammable combustible liquid fuel disposed within the container; and a floating wick assembly comprising, a wick, a buoyant float wick located in the container and having a portion of the wick disposed in the liquid fuel and an exposed portion of the wick located above the fuel and exposed to air for providing a flame site, the wick configured to transport the fuel to the flame site, a magnetic material configured to cooperate with the container magnet to magnetically maintain the wick assembly in a desired position, and fins located on the floating wick assembly to extend above a flame of the wick and to capture convection currents from the flame to cause the floating wick assembly to spin on a magnetic axis provided by the container magnet and the magnetic material of the floating wick assembly.

2. A refillable liquid candle, the candle comprising:

a container;

a nonflammable combustible liquid fuel disposed within the container to an initial height within the container;

a particulate medium disposed within the fuel to a height corresponding to the initial height of the fuel and having a density so at to not float in the fuel; and a tabbed wick assembly comprising an elongate non-consuming wick having an upper end and a lower end, the lower end connected to a tab secured in place in the fluid by the particulate material, and the upper end of the wick extending above the fluid and exposed to air to provide a flame site, the wick configured to transport the fuel to the flame site, wherein the candle consumes the liquid fuel when ignited to provide a flame at the flame site, and the particulate material serving to limit the size of a flame at the flame site.

3. A refillable liquid candle, the candle comprising:

a container;

a nonflammable combustible liquid fuel disposed within the container a plurality of fuels mixed to provide a plurality of distinct liquid fuel layers within the container stacked one on another and extending from an upper portion of the container to a bottom of the container, each layer of fuel providing a different colored flame or fragrance or both; and a floating wick assembly comprising, a wick, a buoyant float, and a heat shield to protect the float, wherein the floating wick assembly is configured to maintain an end of the wick in the liquid fuel while maintaining an opposite end of the wick exposed to air above the fuel, Wherein the candle consumes the liquid fuel when ignited to provide a flame at the flame site which consumes each layer separately in sequence beginning with an uppermost fuel layer.

* * * * *